United States Patent [19]

Stolmar

[11] Patent Number: 4,972,804

[45] Date of Patent: Nov. 27, 1990

[54] METHOD AND APPARATUS FOR ORGANIZING THE FLOW OF FLUID IN A VERTICAL STEAM GENERATOR

[75] Inventor: Aladar Stolmar, Pittsburgh, Pa.

[73] Assignee: Alexander T. Kindling, Pittsburgh, Pa. ; a part interest

[21] Appl. No.: 343,001

[22] Filed: Apr. 25, 1989

[51] Int. Cl.[5] ..... F22B 37/54

[52] U.S. Cl. ..... 122/382; 122/381; 122/379; 134/167 R; 134/180

[58] Field of Search ..... 122/379, 381, 382, 383; 134/167 R, 168 R, 180, 181, 22.1, 22.18, 34

[56] References Cited

U.S. PATENT DOCUMENTS

| | | | |
|---|---|---|---|
| 1,531,348 | 3/1925 | Richardson | 122/379 |
| 3,916,844 | 11/1975 | Cassell | 122/382 |
| 4,024,881 | 5/1977 | Weiland et al. | 134/167 R |
| 4,037,569 | 7/1977 | Bennett et al. | 122/383 |
| 4,040,973 | 8/1977 | Seivós et al. | 252/301.1 N |
| 4,079,701 | 3/1978 | Hickman et al. | 122/382 |
| 4,131,085 | 12/1978 | McDonald | 122/382 |
| 4,276,856 | 7/1981 | Dent et al. | 122/382 |
| 4,452,183 | 6/1984 | Yazidjian | 122/392 |
| 4,492,186 | 1/1985 | Halm | 122/382 |
| 4,526,135 | 7/1985 | Calhoun et al. | 122/382 |
| 4,566,406 | 1/1986 | Appleman | 122/405 |
| 4,629,881 | 11/1986 | Booij | 122/382 X |
| 4,653,435 | 3/1987 | Bebouc | 122/382 |
| 4,676,201 | 6/1987 | Lahoda et al. | 122/392 |
| 4,705,057 | 11/1987 | Mohr et al. | 122/390 X |
| 4,715,324 | 12/1987 | Muller et al. | 122/381 |
| 4,757,785 | 7/1988 | Klahn et al. | 122/382 |
| 4,769,085 | 9/1988 | Booij | 122/382 X |
| 4,773,357 | 9/1988 | Scharton et al. | 134/22.18 |
| 4,838,211 | 6/1989 | Vago | 122/383 |
| 4,848,278 | 7/1989 | Theiss | 122/383 |

*Primary Examiner*—Edward G. Favors
*Assistant Examiner*—Denise L. Ferensic
*Attorney, Agent, or Firm*—Clifford A. Poff

[57] ABSTRACT

Disclosed is an apparatus and method for preventing the formation of stagnate volumes and associated sludge deposition sites in the lower central regions of the steam generating fluid contained in a vertical-tube heat exchanger of a steam generator. The fluid in the steam generator is injected into the heat exchanger by diametrically-opposed flow vanes which direct the fluid in opposite directions near the central region of a heating tube support plate or tube sheet at the lower end of the heat exchanger. The fluid is injected closely adjacent and parallel to the tube sheet surface to thereby induce an initial rotational flow in the fluid, the rotational flow thus introduces horizontal and outwardly directed radial flow components into the vertically flowing fluid in the generator. The unique construction of the flow vanes induces a complex system of vertical, radial and rotational (horizontal) flow components into the steam generating fluid. This complex flow system causes the fluid to separate the portion of dissolved and/or suspended sludge, and, of the sludge which is precipitated from the fluid, such precipitated sludge is directed to by the flow system predetermined collection sites near the periphery of the tube sheet where it can be efficiently and effectively expelled from the steam generator by the blowdown.

27 Claims, 4 Drawing Sheets

METHOD AND APPARATUS FOR ORGANIZING THE FLOW OF FLUID IN A VERTICAL STEAM GENERATOR

BACKGROUND OF THE INVENTION

1. Field of the Invention

This invention relates to organizing the flow of a fluid in a vertical heat exchanger to prevent the formation of a stagnant volume therein and also to direct sludge forming contaminants occurring in the fluid toward predetermined sites for withdrawal from the heat exchanger. More particularly, the present invention is useful in a steam generator of the type in which a multiplicity of heating tubes extend from a tube plate and wherein a rotational flow is induced in the steam generating fluid by introducing the fluid into a bottom central portion of the generator just above the tube plate. The rotational flow washes radially outwardly across the surface of the tube plate to carry salts and/or other contaminants capable of forming sludge to predetermined collection and discharge sites at the periphery of the tube plate.

2. Description of the Prior Art

As is known in the art, a steam generator is a form of heat exchanger used in power plants, particularly nuclear power plants, to produce steam which is used to drive a turbine-generator for the production of electric power. A steam generator of this type includes a bundle of vertically orientated tubes inside a cylindrical shell. In certain steam generators, the tubes are bent to a U-shaped form and fastened in inverted positions to a tube sheet in a lower part of a shell. In other types of steam generators, also called "once through", the tubes are straight and fastened to lower and upper tube sheets located inside the shell. In both types of steam generators, the primary coolant from the nuclear reactor flows inside the vertically orientated tubes in order to heat a fluid medium used for generating steam which flows upwardly in the spaces between the tubes. The tubes in the bundle-formation are relatively long to allow a needed residence time for the heat exchange process. As the fluid rises in the steam generator along the outside surfaces of the bundle of tubes, the fluid is converted to gaseous steam to an ever increasing extent so that after leaving the heat exchanger the steam is separated from the liquid and essentially only steam is drawn off at the top portion of the steam generator in order to drive a turbine generator.

In the liquid-to-gas conversion process the upward volumetric flow rate is ever increasing with a concurrent decreasing density. Under these operating conditions and at the operating pressures of the steam generator, the average concentration of the salt content in the liquid volume increases with time because of the above-mentioned evaporation process, chemical factors, thermal factors, and still other factors. When the concentration of the salt contaminate becomes too great, the salt begins to precipitate out of solution to form sludge deposits.

An equilibrium salt concentration can be achieved in the steam generator water with the organization of a partial blowdown flow and an excess clear feedwater uptake. Nevertheless, the proper selection of blowdown rates does not prevent the sludge collection in a conventional steam generator with turbulent intake at the bottom of the heat exchanger. This is because the low upward flow velocity together with uncontrolled organization of flow channels due to the conversion of liquid to steam contribute to the organization of stagnate fluid volumes. At these stagnate volumes, the sedimentation of the salt, both in the form of ions and in the form of solid particles, can be seen as the intermediate cause for sludge formation. The stagnation sites are prevalent at the cooler flow spaces between the tubes in the lower central part of a steam generator.

In a typical steam generator of the type described, an entry flow of a mixture of feed water and steam generator water is directed into the lower portion of a steam generator through circumferential opening just above the tube sheet and communicating with a downcomer flow space between inner and outer shell members of the generator. As the water mixture enters the tube interspace from the downcomer, the immediate effect by the heat exchange process is an induced upward flow of the fluid, turning the initial horizontal flow of water from the circumferential opening upward, causing channels with elevated velocity to form in accordance with local heat-up rates and isolating the colder parts of the heat exchanger, whereby a stagnation to the fluid flow is further induced. A change in the selection of blowdown uptake location also cannot solve the problem because of the self reorganization of flows under uncontrolled normal operation flow conditions.

The stagnate volume allows the sludge to accumulate on the tube sheet, rise along the tubes and become situated in colder central volumes. Under these conditions, local corrosion occurs. With the ever increasing build-up of sludge, there occurs a need for more frequent down time for maintenance, particularly clean-up operations. As a consequence, more limited and costly restrictions are usually imposed on the quality of feed water that can be used in the steam generator.

SUMMARY OF THE PRESENT INVENTION

It is an object of the present invention to provide for directing the flow of a steam generating fluid in a vertical steam generator of the type having a horizontally oriented tube plate, from which a bundle of heat exchanger tubes arise, in such a manner to eliminate a stagnate fluid flow condition in central colder lower regions of the fluid medium by imparting thereto a directed flow which is generally parallel to the tube plate and of a sufficient velocity and volume to insure fluid movement at lower elevations just above the tube plate which prevent the occurrence of central sites of stagnate fluid.

It is a further object to reduce, control and eliminate the quantity of sludge precipitated at lower regions of a vertical heat exchanger.

It is a further object of the present invention to provide a method and apparatus for introducing a component of flow into a fluid medium of a vertical heat exchanger in a rotational direction just above the tube plate so as to carry sludge-forming contaminants occurring in the fluid medium to predetermined collection and discharge sites at the periphery of the tube plate whereby the sludge-forming contaminants can be effectively and efficiently purged from the heat exchanger.

Still other objects and advantages will become apparent when one considers the attached drawing figures and the description of the invention presented hereinbelow.

DESCRIPTION OF THE PREFERRED EMBODIMENT

Figure 1:
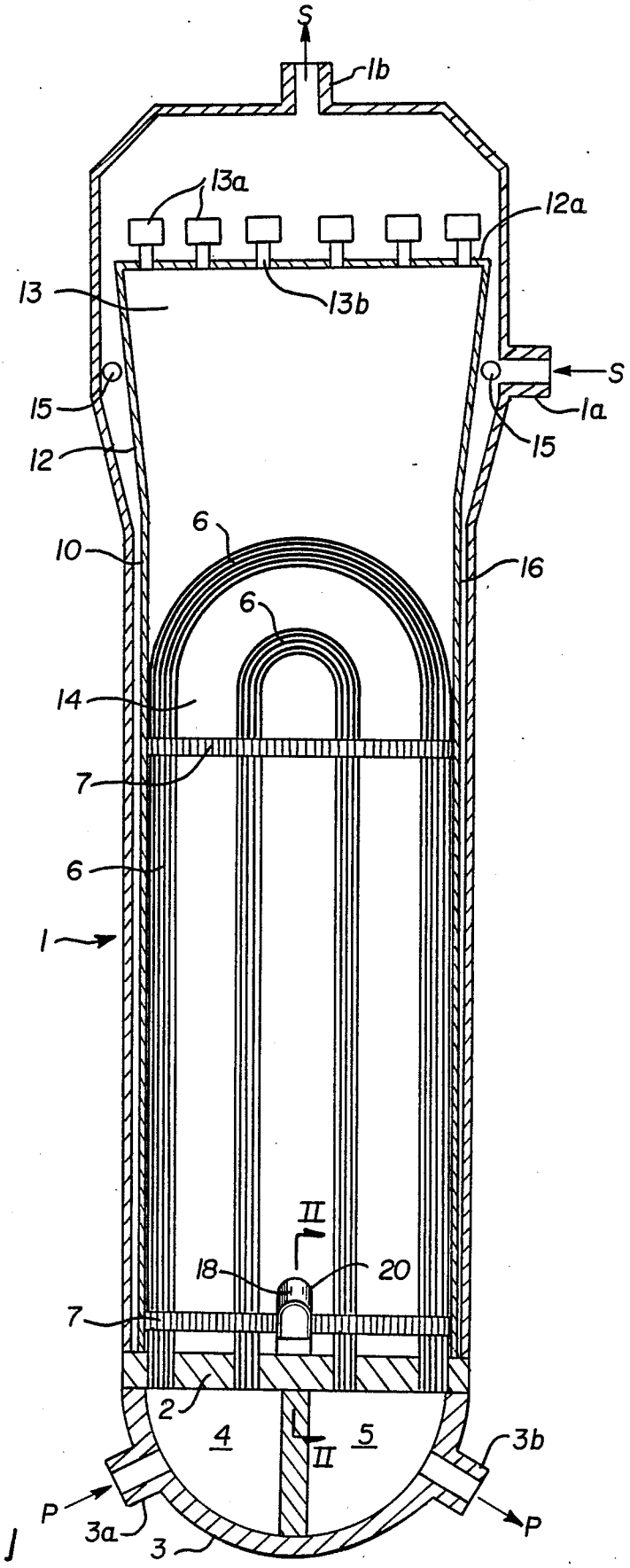
FIG. 1 is a cross-sectional view of a steam generator having fluid flow directing means of the present invention contained therein.
Figure 2:
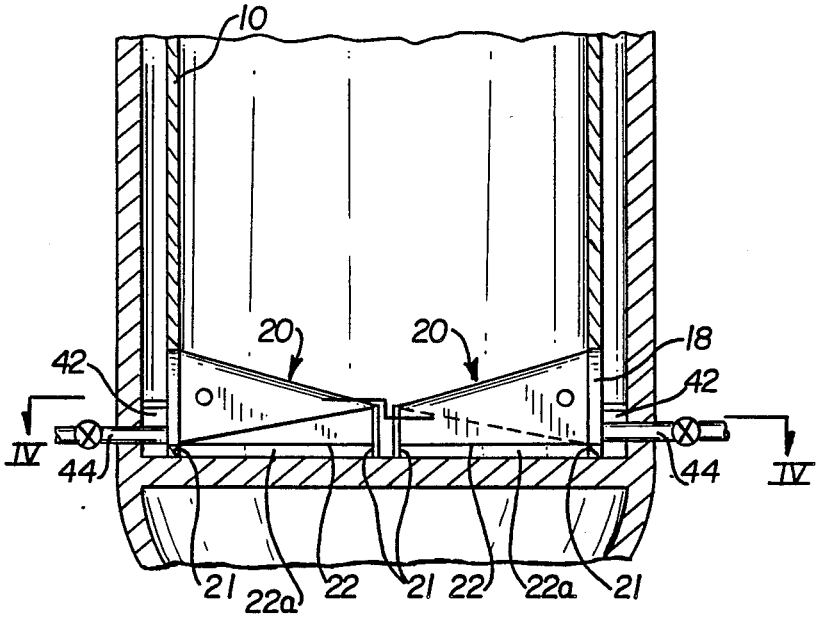
FIG. 2 is a partial cross-sectional view taken along line II—II of FIG. 1 with the heating tubes removed for purposes of clarity.

In FIG. 1 there is illustrated a shell-type heat exchanger wherein a primary working fluid experiences indirect heat exchange with a secondary working fluid. The heat exchanger consists of a vessel 1 having a tube sheet 2 disposed at its lower end portion, and a header 3 attached beneath the tube sheet. The header 3 has an inlet 3A, and outlet 3B, and defines an incoming working fluid chamber 4 and an outgoing inventory chamber 5. A plurality of substantially U-shaped tubes 6 have their respective end portions mounted in the tube sheet 2 for passing fluid from the chamber 4 to chamber 5. Primary working fluid is indicated by arrows P. The vessel 1 has an inlet lA and an outlet lB for secondary working fluid indicated by arrows S. It is understood that secondary fluid S is passed in a heat exchange relation to the primary working fluid P passing through the tubes 6 to raise the temperature of the secondary fluid S to the extent that it is typically converted from a liquid to a gas. In the above arrangement, the role of the tube sheet 2 is basically to fix the location of the tubes 6. The header 3 is of hemispherical configuration with a radius of nearly three times the width of the tube sheet. The inventory volume of the header 3 is therefore relatively large. The interior of the vessel contains a cylindrical peripheral wall in the form of an annular baffle plate 10 which according to the present invention is substantially continuously joined to and extends from the top surface of the tube sheet 2 upwardly about the outer periphery of the bundle of tubes 6 beyond the reverse bends of the tubes where the baffle 10 is then joined with a truncated conical baffle 12. As is known, a plurality of vertically spaced supports 7, also known as tube support plates, maintain the tubes 6 in proper vertical orientation within baffle 10. Baffle 10 is spaced from the shell by supports (not shown).

Baffle 10 forms an inner evaporator chamber 14 and baffle 12 forms a collection chamber 13 wherein a vapor-liquid mixture is processed.

From the mixture collection chamber 13 the flowing mixture is passed to vapor-liquid separator apparatus which includes a multiplicity of separators indicated as 13A being mounted upon baffle plate 12A and communicating with the chamber 13 by means of openings 13B provided in the plate 12A. The separators 13A may be of any well-known construction and are arranged to discharge separated liquid downwardly upon the baffle plate 12A from whence it is returned to an annular downcomer passage 16 to be mixed with the incoming feedwater S and recirculated through the vessel. The separated vapor, on the other hand, is discharged from the separators in the upward direction and passes through the vapor outlet nozzle IB to a point of use. Annular downcomer passageway 16 is formed between the shell of the vessel and annular baffle plate 10. Feed water entering at IA is discharged by a ring shaped header 15 and flows downwardly along the downcomer passage 16. Upstanding slots 18 which provide the only discontinuities between the attachment of baffle plate 10 to the tube sheet 2, are formed in the baffle plate 10 at generally diametrically opposite sites. Slots 18 are connected in a fluid type relation with flow directing vanes in the form of injector housings 20 each having a length sufficient to extend from the baffle 10 to the proximate geometric center of the tube sheet 2. The injector housings 20 are supported by spacer plates 21 at first and second opposite longitudinal end portions thereof which raise the bottom wall 22 of each of the housings 20 above the tube sheet 2 to allow a flow of water in the spaces 22A thus formed beneath the housings 20.

Figure 3:
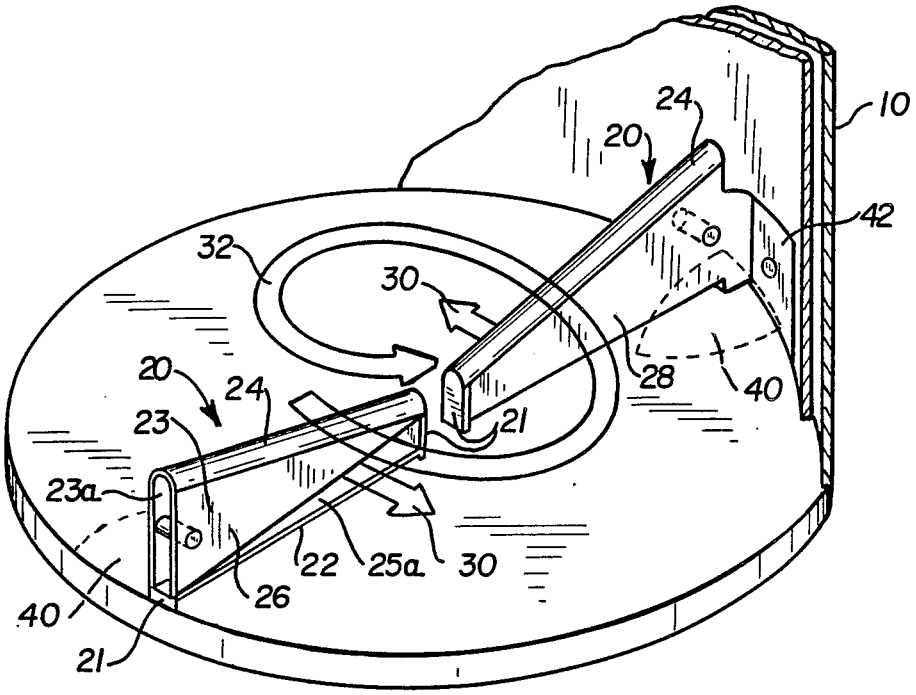
FIG. 3 is a perspective view of the flow directing means of the present invention.
Figure 7:
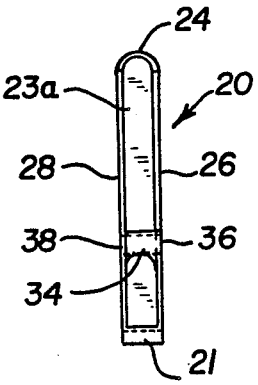
FIG. 7 is a view taken along line VII—VII of FIG. 6.
Figure 5:
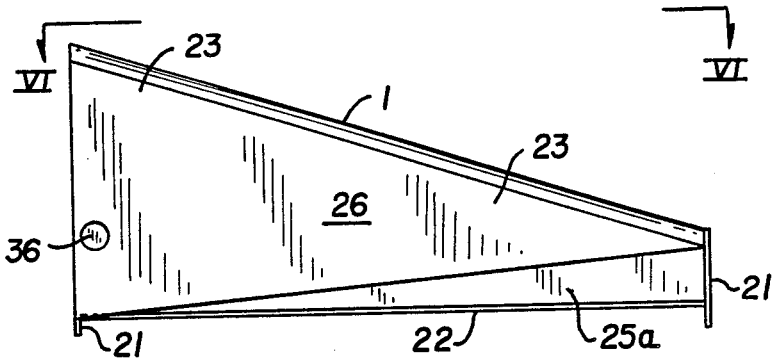
FIG. 5 is an enlarged side view of one of the flow directing means of the present invention.
Figure 6:
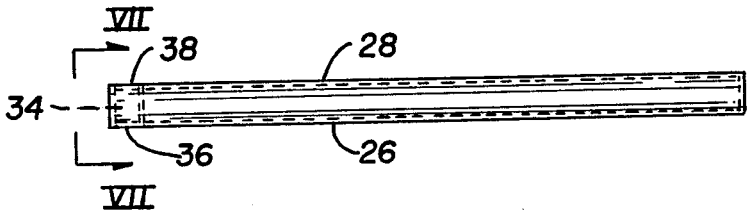
FIG. 6 is a view taken along line VI—VI of FIG. 5.

As depicted in FIGS. 3, 5 and 7, flow vanes or injector housings 20 each have a top wall 24 and opposed substantially vertical side walls 26 and 28 downwardly extending therefrom to bottom wall 22. The radially innermost portions of top wall 24, side walls 26 and 28, and bottom wall 22 are closed by the spacer plate 21 located proximate the central portion of tube sheet 2. Preferably, top wall 24 is semicircular in cross-section and extends in an upwardly inclined fashion from the central spacer plate 21 to the juncture of housing 20 with upstanding slots 18 formed in baffle 10. It is also contemplated that the top wall 24 may be flat, peaked or of some other cross section and may extend in horizontal fashion generally parallel to the tube sheet 2 and, the side walls 26 and 28 may diverge from top wall 24 to bottom wall 22. The top wall 24, side walls 26 and 28, and bottom wall 22 are joined to baffle 10 at slots 18 such that steam generator downcomer flow can only enter the enclosed volume of the steam generator through housings 20. The juncture of each housing 20 with baffle 10 thus forms an inlet portion 23 of housing 20. Inlet portion 23 has inlet 23A provided therein. Opposite the inlet portion 23 is outlet portion 25 formed by wall 26 having outlet 25A therein. Outlet 25A extends substantially perpendicularly to inlet 23A. In the preferred embodiment, as best shown in FIGS. 3 and 5, outlet portion 25 is provided with an outlet 25A which is triangular in shape with the base of the triangular shape being located at innermost spacer plate 21 and the apex of the triangular shape pointing toward, but preferably spaced from, baffle 10.

As one can clearly see, the fluid or downcomer water flow which enters the enclosed volume of the baffle 10 through each of the flow vanes or injector housings 20 is supplied at greatest volume nearest central spacer plate 21. This is because the size of triangular outlet 25A is greatest adjacent the proximate center of tube sheet 2. Therefore, the greatest volume of downcomer water is injected into the steam generator near the central-most regions thereof, with decreasing volumes being injected at increasing radial distance from the center. The relative volumes of injected feed water are best illustrated by the oppositely directed arrow gradients shown in FIG. 4.

Referring to FIG. 3, it can be seen that the feed water is injected through housings 20 in opposite directions as depicted by arrows 30. Since the spacer plates 21 generally support the flow vanes or injector housings 20 approximately 1"above the surface above tube sheet 2, the feed water is injected in a substantially horizontal direction closely adjacent to, and substantially parallel with, the tube sheet 2. The oppositely directed injected feed water thus creates a force couple within the fluid contained in the lower regions of the steam generator to thereby induce an initial rotational flow in the contained fluid. This situation is illustrated by rotational arrow 32 shown in FIG. 3. This induced rotational flow introduces horizontal flow component into the naturally occurring vertical flow of the fluid contained within the steam generator. And, since the induced rotational flow is greatest in the central regions of the steam generator, at least three significant benefits are achieved.

First, the creation of stagnate volumes of water in the central regions of the steam generator are avoided. As is known, such stagnate volumes are responsible for the precipitation of sludge deposits in the form of salts and/or other contaminants normally occurring in the generator feed water. When the stagnate volumes are present in the central regions of the generator, sludge deposits form which cannot be satisfactorily purged by blowdown of the generator. A "blowdown" is generally understood to mean a purging of contaminants by an operation in which the feed water is pumped in excess amounts over that which is routed out of the steam outlet. The excess flow is then routed out from the lower elevations of the liquid volume of the steam generator through a designated blowdown pipeline. However, in the past, the sludge became so amassed in a single centralized location of the generator that all of the sludge could not be purged from the generator, even in such cases where a blowdown drain hole was provided in a central portion of the tube sheet. As mentioned above, the induced rotational flow provided by the flow vanes 20 of the present invention prevents stagnate volumes of water in the central regions of the generator and, thus, prevents the formation of single centralized masses of sludge in the generator.

Second, the induced rotational flow provided by the flow vanes or injection housings 20 greatly reduces the amount of sludge which may precipitate since the suspended sludge is under the influence of rotational (horizontal), vertical (including gravity), and radial force vectors which act in concert to separate the heavier, more dense sludge-forming contaminants toward the periphery of the generator.

Third, by the unique construction of the flow vane and the unique graduated rotational flow produced thereby, the location at which the heavier, greater specific gravity sludge-forming contaminants become concentrated can be carefully and advantageously controlled that the contaminants collect at predetermined sites adjacent the baffle for efficient and complete purging of the sludge-forming contaminants by the blowdown operation.

Figure 4:
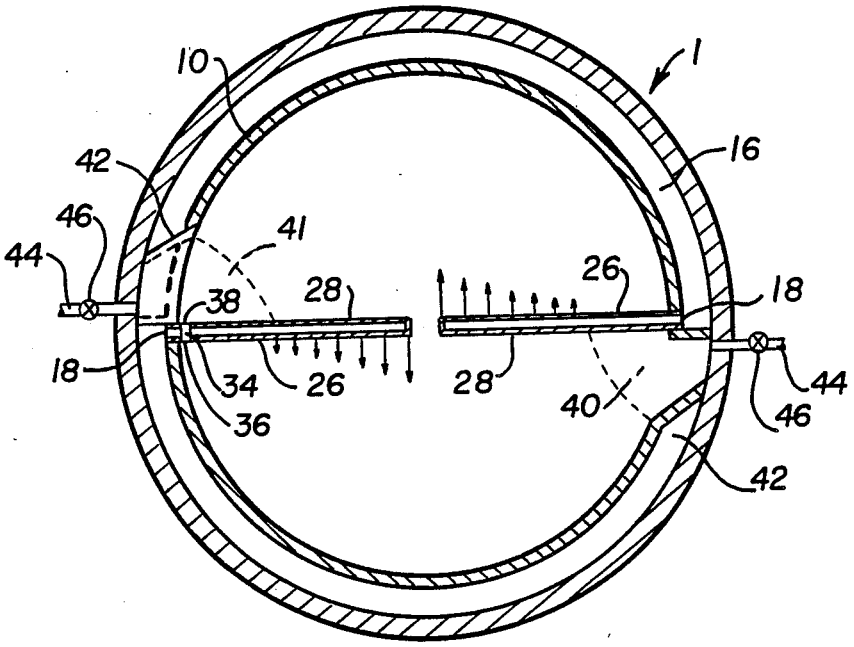
FIG. 4 is a plan view in section of the flow directing means of the present invention taken along line IV—IV of FIG. 2.

As most clearly seen in FIGS. 2–7 each the flow vanes or injector housings 20 includes a tube or pipe means 34, generally parallel to the surface of tube sheet 2, which interconnects openings 36 and 38 provided in side walls 26 and 28, respectively, at substantially the same elevation as the lowest tube support plate 7. Tube means 34 permits a portion of flow having high concentrations of sludge-forming contaminants to pass from the side of the injector housing adjacent side wall 28, through tube means 34, to the side of the injector housing adjacent side wall 26. The presence of tube means 34, along with spaces 22A, aids in maintaining the rotational flow induced by the injector housings by permitting fluid and the contaminants suspended therein to pass through and beneath the injector housings to permit sedimentation of the contaminants below the lowest tube support plate. Without the presence of tube means 34 and spaces 22A, the fluid would otherwise be blocked or at least greatly inhibited from flowing from one side of the injector housings to the other thus essentially destroying the advantageous rotational flow induced by the housing. However, as will be described below, a certain degree of such fluid blockage is necessary in order to create the sludge collection and discharge sites near the periphery of the tube plate end at the upstream side 28 of each of the housing 20. The diameter of the tube means 34 and the associated openings 36 and 38 is appropriately selected so that only a portion of the flow may pass through tube means 34 from side 28 to side 26 in order to maintain rotational flow. However, the diameter of the tube means 34 must be selected so that a portion of the feed water becomes "dammed-up" at upstream side 28 of each of the housings 20. This "damming-up" of water at side 28 of each housing 20 creates small, controlled, but necessary, volumes of stagnate fluid which permit concentrated sludge-forming contaminants 40, designated in phantom lines in FIGS. 3 and 4, to be collected beneath port 38 of each housing onto tube sheet 2 and adjacent baffle 10. It is noted that the situation depicted in FIGS. 3 and 4 is one in which the blowdown pipe would be closed for an extended period of time.

As shown in FIG. 4, sludge catcher boxes 42 are provided in baffle plate 10 immediately adjacent the upstream side 28 of each injector housing 20. At such times when concentrated sludge-forming contaminants 40 at upstream sides 28 become so amassed that an elevated rate blowdown operation becomes necessary, the concentrated liquid collected near the sludge catcher boxes 42 can be effectively purged when the blowdown rate increase performed and sludge-forming contaminants 40 are purged through sludge catcher boxes 42. During periodical high rate blowdown, the purged sludge-forming contaminants/concentrated liquid may be conveniently passed through blowdown pipelines 44 (FIG. 2) provided in lower portions of the shell near sludge catcher boxes 42. Due to the unique flow characteristics provided by the present invention, the sludge is being eliminated from the steam generator using the same blowdown rate as in prior art steam generators. This is because in the construction of the present invention, the concentrated liquid/contaminants is effectively purged.

Figure 8:
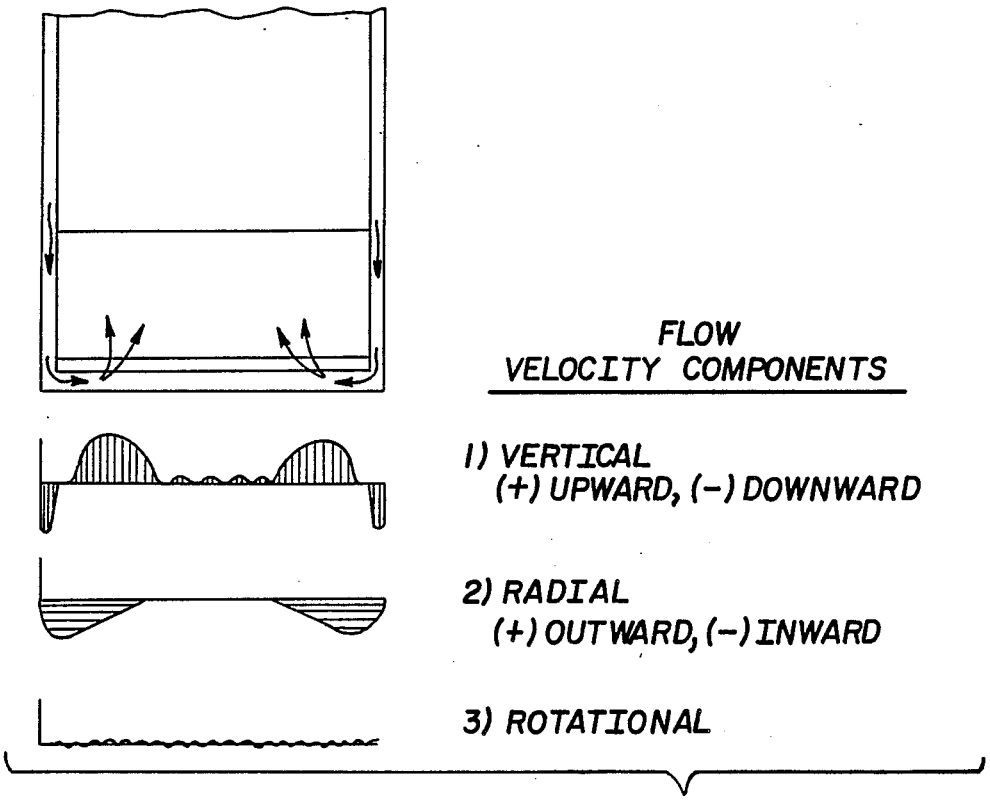
PRIOR ART FIG. 8
FIG. 8 describes the flow patterns of a steam generating fluid in a vertical steam generator without the flow directing means of the present invention.
Figure 9:
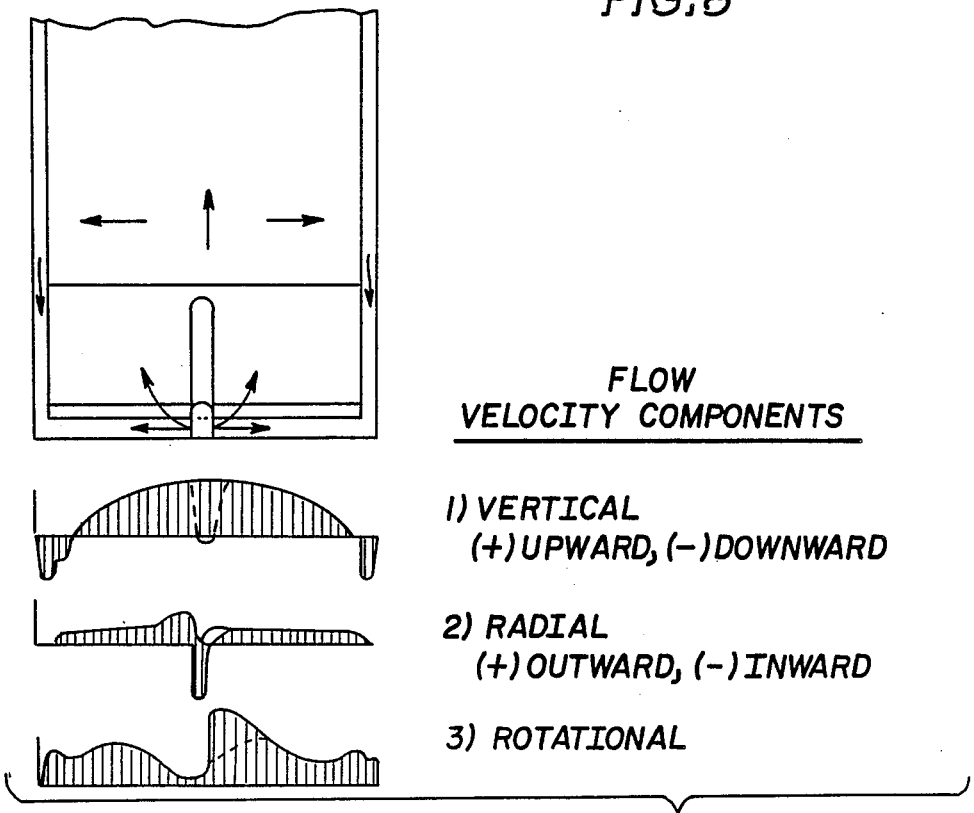
FIG. 9 describes the flow patterns of a steam generating fluid in a vertical steam generator with the flow directing means of the present invention.

FIGS. 8 and 9 graphically illustrate and compare the velocity components of downcomer water flow occurring in steam generators with and without flow vane means or injector housings 20 like those disclosed herein. FIG. 8 depicts the velocity components of flow in a prior art steam generator in which downcomer water is introduced through a continuous circumferential space between the baffle and the tube sheet and FIG. 9 illustrates the velocity components of flow in a steam generator constructed in accordance with the present invention, i.e., where the downcomer flow is injected only at discreet central regions of the steam generator.

In each of FIGS. 8 and 9, the upper graph illustrates the vertical component of flow, the middle graph illustrates the radial component of flow, and the lower graph illustrates the rotational component of flow. As is clear from FIG. 8, the central region of the vertical flow graph is approximately zero, thus indicating the existence of stagnate volumes in this region. At the same time, the central region of the vertical flow graph of FIG. 9 indicates strong positive vertical flow near the central regions and negative vertical flow adjacent the baffle. This indicates that sludge must be precipitated near outer peripheral regions of the steam generator of FIG. 9.

A comparison of the radial components of flow of FIGS. 8 and 9 reveals a similar situation. As can seen from FIG. 8, the radial flow is negative, i.e., inward, at outer regions of the generator and zero in central regions thereof. Again, this indicates that sludge is carried inward toward central regions of the generator and deposited thereat due to stagnate volumes of water in the central regions. The graph of the radial component of flow in FIG. 9, on the other hand, indicates that the radial flow is positive, i.e. outward, throughout most of the regions of the steam generator, thus indicating a flow outward to carry sludge to peripheral regions of the tube sheet. A small central region of the radial flow graph of FIG. 9 indicates a negative or inwardly directed radial flow representing the presence of injection housing 20.

The rotational flow velocity graph of FIG. 8 indicates that rotational flow is essentially zero in prior art steam generator constructions. However, the rotational flow velocity graph of FIG. 9 indicates a positive rotational flow in virtually all regions of a steam generator constructed in accordance with the present invention. The introduction of the positive rotational flow advantageously influences the vertical and radial flow components so that a steam generator constructed according to the present invention will separate the heavier sludge-forming ions and particles and be more easily and effectively operated and maintained than the steam generators of the prior art.

While the present invention has been described in accordance with the preferred embodiments of the various figures, it is to be understood that other similar embodiment may be used or modifications and additions may be made to the described embodiment for performing the same functions of the present invention without deviating therefrom. Therefore, the present invention should not be limited to any single embodiment but rather construed in breadth and scope in accordance with the recitation of the appended claims.

What is claimed is:

1. A method for influencing the vertical flow of a steam generating fluid in a vertical steam generator, said vertical steam generator having an enclosed volume defined by a cylindrical wall and a lower tube plate, said tube plate having an array of heating tubes extending therefrom for heating said steam generating fluid to produce steam therefrom, said method comprising:

(a) inducing a rotational flow in said steam generating fluid in a horizontal plane generally parallel to and closely adjacent to a surface of the tube plate, said rotational flow introducing a horizontal flow component into the vertically flowing steam generating fluid in the steam generator, said rotational flow being induced by introducing a downcomer fluid into said enclosed volume at at least one site along a central portion of said tube plate, said downcomer fluid being introduced at greatest amounts nearest the central portion of said tube plate;

(b) carrying sludge-forming contaminants occurring in a lower portion of the steam generator via said induced rotational flow to predetermined purging sites adjacent the cylindrical wall; and (c) purging the concentrated sludge-forming contaminants from said purging sites.

2. The method of claim 1 further comprising introducing said downcomer fluid at two sites along, and on diametrically opposed sides of, said central portion of said tube plate.

3. The method of claim 2 further comprising introducing said downcomer fluid from a first of said two sites in a first direction and simultaneously introducing said fluid from a second of said two sites in a second direction opposite to said first direction.

4. The method of claim 3 further comprising introducing said downcomer fluid from said two sites at greatest amounts nearest the central portion of said tube plate and at decreasing amounts at increasing radial distance therefrom.

5. The method of claim 1 wherein said purging step is performed by a blowdown.

6. The method of claim 1 further comprising establishing said purging sites in said cylindrical wall adjacent blowdown pipelines provided in a shell of said steam generator surrounding said cylindrical wall and discharging said concentrated sludge-forming contaminants by a blowndown which expels the concentrated sludge-forming contaminants from said purging sites through said blowdown pipelines.

7. The method of claim 3 wherein said two sites are formed by separate flow directing means each having a first side and a second side, said downcomer fluid being introduced into said enclosed volume from said first side of each said flow directing means and one of said predetermined purging sites being located on said second side of each said flow directing means.

8. The method of claim 7 further comprising directing fluid from said second side to pass through said flow directing means and communicate with fluid on said first side.

9. The method of claim 8 wherein said step of directing includes causing fluid to flow between said flow directing means and said tube plate.

10. Apparatus for influencing the vertical flow of a steam generating fluid in a vertical steam generator, said steam generator having an enclosed volume defined by a cylindrical wall secured at a lower end thereof to a tube plate, said tube plate having an array of heating tubes extending therefrom for heating said fluid to produce steam therefrom, said apparatus comprising:

flow directing means for inducing a rotational flow in said fluid in a horizontal plane generally parallel to and closely adjacent to a surface of the tube plate, said rotational flow introducing a horizontal flow component into the vertically flowing fluid in the steam generator;

said flow directing means comprising at least one flow vane means extending radially inwardly from said cylindrical wall, said flow vane means permitting said fluid to flow therethrough into said enclosed volume, a lower edge of said cylindrical wall being continuously attached to said tube plate such that said fluid is permitted to enter said enclosed volume only through said flow vane means, each of said flow vane means comprising an inlet portion secured to said cylindrical wall and an outlet portion extending radially inwardly from said inlet portion, said inlet portion forming an inlet opening and said outlet portion forming an outlet opening, said fluid enters said inlet opening and exits said outlet opening to enter said enclosed volume, said outlet opening being arranged substantially perpendicular to said inlet opening; and at least one sludge discharge passage formed in said cylindrical wall adjacent said flow vane means, whereby said fluid enters said enclosed volume through said flow vane means to thereby induce a rotational flow in said fluid, said induced rotational flow in said fluid carries sludge-forming contaminants occurring therein to predetermined collection sites formed at junctures of said flow vane means and said cylindrical wall for concentrated collection thereat, said concentrated sludge-forming contaminants then being capable of being discharged through said at least one discharge passage and at least one blowdown pipeline.

11. The apparatus of claim 10 wherein said outlet opening of each flow vane means is spaced from said cylindrical wall and adjacent a central portion of said tube plate.

12. The apparatus of claim 11 wherein said flow directing means comprise two flow vane means.

13. The apparatus of claim 12 wherein said flow vane means are variable in cross section.

14. The apparatus of claim 13 wherein each of said flow vane means decrease in cross-sectional area from said inlet portion to said outlet portion.

15. The apparatus of claim 14 wherein said outlet opening of each flow vane means decreases in size from a radially innermost portion thereof to a radially outermost portion thereof.

16. The apparatus of claim 11 wherein said outlet opening of each flow vane means decreases in size from a radially innermost portion thereof to a radially outermost portion thereof.

17. The apparatus of claim 15 wherein each flow vane means has a first side and a second side, said fluid being introduced into said enclosed volume from said outlet opening on said first side, and one of said predetermined collection sites being located on said second side of each flow vane means adjacent a peripheral position of said tube plate.

18. The apparatus of claim 16 wherein each flow vane means has a first side and a second side, said fluid being introduced into said enclosed volume from said outlet opening on said first side, and one of said predetermined collection sites being located on said second side of each flow vane means adjacent a peripheral portion of said tube plate.

19. The apparatus of claim 17 further comprising communication means associated with said flow vane means for permitting fluid from said second side to pass through said flow vane means and communicate with fluid on said first side.

20. The apparatus of claim 19 wherein said communication means comprise a flow space between said flow vane means and said tube plate, said flow space being formed by foot means depending from said flow vane means for maintaining said flow vane means in spaced relationship with said tube plate.

21. The apparatus of claim 20 wherein said communication means further comprise port means formed in spaced opposed walls of said flow vane means and means connecting said port means.

22. The apparatus of claim 21 wherein said means connecting said port means comprise tube means.

23. The apparatus of claim 18 wherein said communication means comprise a flow space between said flow vane means and said tube plate, said flow space being formed by foot means depending from said flow vane means for maintaining said flow vane means in spaced relationship with said tube plate.

24. The apparatus of claim 23 wherein said communication means further comprise port means formed in spaced opposed walls of said flow vane means and means connecting said port means.

25. The apparatus of claim 24 wherein said means connecting said port means comprise a cylindrical tube isolating the flow therethrough from the flow directed by said flow directing means.

26. Apparatus for influencing the vertical flow of a steam generating fluid in a vertical steam generator, said steam generator having enclosed volume defined by a cylindrical wall secured at a lower end thereof to a tube plate, said tube plate having an array of heating tubes extending therefrom for heating said fluid to produce steam therefrom, said apparatus comprising:

flow directing means for inducing a rotational flow in said fluid in a horizontal plane generally parallel to a surface of the tube plate, said rotational flow introducing a horizontal flow component into the vertically flowing fluid in the steam generator;

said flow directing means comprising at least one flow vane means, said flow vane means permitting said fluid to flow therethrough into said enclosed volume, a lower edge of said cylindrical wall being continuously attached to said tube plate such that said fluid is permitted to enter said enclosed volume only though said flow vane means, each of said flow vane means comprising an inlet portion and an outlet portion, said inlet portion forming an inlet opening and said outlet portion forming an outlet opening, said fluid enters said inlet opening and exits said outlet opening to enter said enclosed volume, said outlet opening being arranged substantially perpendicular to said inlet opening;

and at least one passage formed in said wall adjacent said flow vane means for discharging sludge-forming contaminants occurring in said fluid, whereby said fluid enters said enclosed volume through said flow vane means to thereby induce a rotational flow in said fluid, said induced rotational flow in said fluid carries sludge-forming contaminants occurring therein to predetermined concentrated collection sites formed adjacent said peripheral wall for concentration thereat, said collected sludge forming contaminants then being capable of being discharged through said at least one passage and through a blowdown pipeline associated therewith.

27. A method for influencing the vertical flow of a steam generating fluid in a vertical steam generator, said vertical steam generator having an enclosed volume defined by a cylindrical wall and a lower tube plate, said tube plate having an array of heating tubes extending therefrom for heating said steam generating fluid to produce steam therefrom, said method comprising:

(a) inducing a rotational flow in said steam generating fluid in a horizontal plane generally parallel to and closely adjacent to a surface of the tube plate, said rotational flow introducing a horizontal flow component into the vertically flowing steam generating fluid in the steam generator, said rotational flow being induced solely by introducing downcomer steam generating fluid into said enclosed volume at at least one site along a central portion of said tube plate, said downcomer steam generating fluid being introduced at greatest amounts nearest the central portion of said tube plate;

(b) establishing predetermined sludge-forming contaminant purging sites by damming-up a portion of said steam generating fluid to inhibit the rotational flow thereof in order to enhance precipitation of sludge-forming contaminants occurring in a lower portion of the steam generator;

(c) carrying said sludge-forming contaminants occurring in a lower portion of the steam generator via said induced rotational flow to said predetermined purging sites to create a concentration of said sludge-forming contaminants at said purging sites; and (d) purging the concentrated sludge-forming contaminants from said purging sites.

* * * * *